US012751491B2

(12) United States Patent
Zhou et al.

(10) Patent No.: US 12,751,491 B2
(45) Date of Patent: Oct. 6, 2026

(54) AEROSOL GENERATION APPARATUS AND AEROSOL GENERATION SUBSTRATE

(71) Applicant: SHENZHEN SMOORE TECHNOLOGY LIMITED, Shenzhen (CN)

(72) Inventors: Hongming Zhou, Shenzhen (CN); Jiao Zhang, Shenzhen (CN); Junjie Xiao, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 493 days.

(21) Appl. No.: 17/861,495

(22) Filed: Jul. 11, 2022

(65) Prior Publication Data

US 2022/0338547 A1 Oct. 27, 2022

Related U.S. Application Data

(63) Continuation of application No. PCT/CN2021/072166, filed on Jan. 15, 2021.

(30) Foreign Application Priority Data

Jan. 16, 2020 (CN) ..... 202010048131.2

(51) Int. Cl.
*A24F 40/465* (2020.01)
*A24D 1/20* (2020.01)
*A24F 40/42* (2020.01)

(52) U.S. Cl.
CPC ..... *A24F 40/465* (2020.01); *A24D 1/20* (2020.01); *A24F 40/42* (2020.01)

(58) Field of Classification Search
None
See application file for complete search history.

(56) References Cited

U.S. PATENT DOCUMENTS 5,159,940 A * 11/1992 Hayward ..... A24B 15/165 131/365
2014/0338686 A1* 11/2014 Plojoux ..... A24F 40/485 131/329
2017/0071250 A1* 3/2017 Zinovik ..... A24D 1/20
(Continued)

FOREIGN PATENT DOCUMENTS

CN 206227715 U 6/2017
CN 108552598 A * 9/2018 ..... A24F 47/008
(Continued)

OTHER PUBLICATIONS

CN108634380A English Translation obtained from Espacenet, pp. 1-10 (Year: 2024).*

(Continued)

*Primary Examiner* — Philip Y Louie
*Assistant Examiner* — Virginia R Bieger
(74) *Attorney, Agent, or Firm* — Leydig, Voit & Mayer, Ltd.

(57) ABSTRACT

An aerosol generation substrate includes: a main body for generating aerosol after being heated, magnetic particles being distributed in the main body, the magnetic particles generating heat through electromagnetic induction to heat the main body; and a cooling member sleeved on the main body and for assisting in cooling of the main body.

18 Claims, 4 Drawing Sheets

(56) References Cited

U.S. PATENT DOCUMENTS

| | | | | |
|---|---|---|---|---|
| 2017/0079325 | A1* | 3/2017 | Mironov | A24B 13/00 |
| 2017/0095003 | A1* | 4/2017 | Mironov | H05B 6/106 |
| 2017/0360102 | A1 | 12/2017 | Li et al. | |
| 2018/0049472 | A1* | 2/2018 | Mahler | A24F 40/40 |
| 2019/0124981 | A1 | 5/2019 | Fursa | |
| 2020/0068953 | A1* | 3/2020 | Rogan | A24F 40/40 |
| 2020/0093182 | A1* | 3/2020 | Monsalud | A24B 13/02 |
| 2020/0345070 | A1 | 11/2020 | Ding | |
| 2021/0093009 | A1* | 4/2021 | Park | H05B 6/108 |

FOREIGN PATENT DOCUMENTS

| | | | |
|---|---|---|---|
| CN | 108634371 | A | 10/2018 |
| CN | 108634376 | A | 10/2018 |
| CN | 108634378 | A | 10/2018 |
| CN | 108634380 | A | 10/2018 |
| CN | 108669657 | A | 10/2018 |
| CN | 109393567 | A | 3/2019 |
| CN | 109475194 | A | 3/2019 |
| CN | 110074457 | A | 8/2019 |
| CN | 110664005 | A | 1/2020 |
| CN | 111109684 | A | 5/2020 |
| CN | 212014450 | U | 11/2020 |

OTHER PUBLICATIONS

Matweb, "Graphite, Carbon, C", https://matweb.com/search/DataSheet.aspxMatGUID=3f64b985402445c0a5af911135909344&ckck=1 (Year: 2024).*

CN-108552598-A, Description English Translation obtained from Espacenet, pp. 1-16 (Year: 2025).*

Associated Ceramics "Alumina Ceramic—Aluminum Oxide", 2017 (Wayback Macine/Internet Archive) (Year: 2025).*

Jozef Drga, Jozef Chovanec, and Stanislav Šimkovičl, "Density of States and Magnetic Properties of Al2O3 , Cr2O3 and CrO2", XIth International Conference Preparation of Ceramic Materials, Conference Paper • Jun. 2015, pp. 130-135 (Year: 2015).*

European Patent Office, Search Report in European Patent Application No. 21741238.6 (May 26, 2023).

Patent Cooperation Treaty, International Search Report, International Application No. PCT/CN2021/072166 (Apr. 13, 2021).

Patent Cooperation Treaty, Written Opinion of the International Searching Authority, International Application No. PCT/CN2021/072166 (Apr. 13, 2021).

Chinese Patent Office, Office Action in Chinese Patent Application No. 202010048131.2 (Sep. 25, 2024).

CN/202010048131.2, Office Action, Sep. 25, 2024.

* cited by examiner

AEROSOL GENERATION APPARATUS AND AEROSOL GENERATION SUBSTRATE

CROSS-REFERENCE TO PRIOR APPLICATION

This application is a continuation of International Patent Application No. PCT/CN2021/072166, filed on Jan. 15, 2021, which claims priority to Chinese Patent Application No. CN 202010048131.2, filed on Jan. 16, 2020. The entire disclosure of both applications is hereby incorporated by reference herein.

FIELD

The present invention relates to the field of aerosol generation devices, and in particular, to an aerosol generation device and an aerosol generation substrate therefor.

BACKGROUND

Existing aerosol generation systems usually include an aerosol generation substrate and a heating device. The aerosol generation substrate includes a substrate material capable of generating aerosol after being heated, and the aerosol generation substrate generates aerosol after being heated by the heating device. Heat-not-burn is a heating manner for the aerosol generation system, and the aerosol generation substrate generates aerosol in a heat-not-burn baking manner.

Referring to FIG. 1 to FIG. 3, common forms of a heating device used in a current heat-not-burn aerosol generation system include a form (referring to FIG. 1) in which a central heating rod 3*a* is arranged in an aerosol generation substrate 4, a form (referring to FIG. 2) in which a central heating sheet 3*b* is arranged in an aerosol generation substrate 4, and a form (referring to FIG. 3) in which a peripheral heating tube 3*c* is arranged around an aerosol generation substrate 4, where arrows in the figures represent heat transfer directions.

However, the three electric-heating-type heating elements mentioned above take a relatively long time to preheat; and after heating is stopped, the aerosol generation substrate needs to take a relatively long time to cool down.

The heat-not-burn aerosol generation system is generally applied to a heat-not-burn electronic cigarette. The heat-not-burn electronic cigarette is also referred to as a low-temperature baking cigarette or a low-temperature cigarette. The low-temperature cigarette is described with respect to a conventional cigarette, the conventional cigarette is smoked by burning tobacco, and a local burning temperature of the conventional cigarette during smoking may range from 600° C. to 900° C. However, for the low-temperature cigarette, tobacco is heated in a manner of baking instead of burning, a baking temperature of the cigarette is usually less than 400° C. and is commonly about 250° C. Therefore, the cigarette is referred to as the low-temperature baking cigarette or the low-temperature cigarette. Since the foregoing problems exist in the current heat-not-burn aerosol generation system, corresponding problems also exist in the current low-temperature cigarette: a preheating time is relatively long (where preheating usually lasts for more than 10 s, while normal inhaling lasts for 1 s to 5 s); and after baking is stopped by a cigarette device, the tobacco needs to take a relatively long time to cool down due to a low thermal conductivity of the tobacco.

Therefore, a technical solution for quickly heating and quickly cooling the aerosol generation substrate is required.

SUMMARY

In an embodiment, the present invention provides an aerosol generation substrate, comprising: a main body configured to generate aerosol after being heated, magnetic particles being distributed in the main body, the magnetic particles being configured to generate heat through electromagnetic induction to heat the main body; and a cooling member sleeved on the main body and configured to assist in cooling of the main body.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
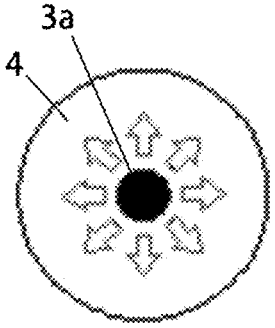
FIG. 1 to FIG. 3 are respectively schematic cross-sectional views of a cigarette in three different manners of heating an aerosol generation substrate in the related art.

In an embodiment, the present invention provides an aerosol generation device and an aerosol generation substrate therefor in view of the foregoing defects in the related art.

In an embodiment, the present invention includes: providing an aerosol generation substrate, including a main body capable of generating aerosol after being heated, where magnetic particles are distributed in the main body, the magnetic particles generate heat through electromagnetic induction to heat the main body, and the aerosol generation substrate further includes a cooling member sleeved on the main body and configured to assist in heat dissipation of the main body.

Preferably, the cooling member is made of a heat sink material.

Preferably, a thermal conductivity of the cooling member is not less than 10 W/(m·K), a density is less than 6000 kg/m$^3$ and/or a specific heat capacity is less than 3000 J/(kg·K).

Preferably, the thermal conductivity of the cooling member is not less than 20 W/(m·K), the density is less than 4000 kg/m$^3$ and/or the specific heat capacity is less than 1500 J/(kg·K).

Preferably, the cooling member is non-magnetic shielding.

Preferably, the cooling member is paramagnetic or diamagnetic.

Preferably, the cooling member is made of a ceramic material.

Preferably, the cooling member is made of an aluminum oxide material or an aluminum nitride material.

Preferably, an accommodation cavity and a first opening are provided in the cooling member, and the first opening is provided on one side of the cooling member and is in communication with the accommodation cavity, so that the main body passes through the first opening and is sheathed in the accommodation cavity.

Preferably, a second opening in communication with the accommodation cavity is provided on an other side of the cooling member.

Preferably, the magnetic particles are made of a Fe material and/or a Ni material.

Preferably, diameters of the magnetic particles range from 20 μm to 200 μm.

Preferably, diameters of the magnetic particles range from 50 μm to 150 μm.

Preferably, a mixing proportion of the magnetic particles in the main body ranges from 1% to 50%.

Preferably, the mixing proportion of the magnetic particles in the main body ranges from 3% to 30%.

The technical solutions adopted by the present invention to solve the technical problem further include: providing an aerosol generation device, including the foregoing aerosol generation substrate and a heat-not-burn baking device configured to heat the main body of the aerosol generation substrate, where the heat-not-burn baking device includes a housing and further includes a supporter and an electromagnetic induction heating assembly that are arranged in the housing, and a loading cavity for loading the aerosol generation substrate is provided in the supporter, so that the electromagnetic induction heating assembly enables the magnetic particles in the aerosol generation substrate to generate heat through electromagnetic induction, to heat the main body of the aerosol generation substrate.

Preferably, a frequency of the electromagnetic induction heating assembly is 150 kHz or above.

Preferably, an end of the cooling member is open for inserting a cigarette, an air hole in communication with inside and outside is provided at an other end of the cooling member, a support portion that supports an end of the supporter provided with the air hole is arranged on the bottom of the housing, and the air hole is at a distance from an inner side wall of the housing, so that air in the housing flows into the loading cavity through the air hole.

Preferably, a first air inlet is provided on the top of the housing and/or a second air inlet is provided on the bottom of the housing, so that air flows into the housing and then flows into the loading cavity of the supporter.

Preferably, the aerosol generation device further includes an air pressure sensor that is arranged in the housing and configured to sense an airflow in the housing.

Beneficial Effects of the Invention

Beneficial Effects

The technical solutions for implementing the present invention have at least the following beneficial effects: According to an aspect, since the magnetic particles are distributed in the main body of the aerosol generation substrate, thermal energy does not need to be transferred over a long distance. Therefore, the aerosol generation substrate can be quickly baked to generate aerosol, and a heating time is greatly shortened. According to another aspect, since the cooling member is sleeved on the main body of the aerosol generation substrate, once heating is stopped, the main body of the aerosol generation substrate can be quickly cooled down under the action of the cooling member, thereby achieving the objective of quick heating and quick cooling.

Reference numerals in the figures represent: 1—Heat-not-burn baking device; 11—Housing; 111*a*—First cavity; 111*b*—Second cavity; 112—Support portion; 1121—Vent channel; 110—Entry; 113—First air inlet; 114—Second air inlet; 115—Hole; 12—Supporter; 121—Loading cavity; 122—Air hole; 13—Induction coil; 14—Air pressure sensor; 15—Power supply; 16—Circuit control unit; 2—Aerosol generation substrate; 21—Main body; 22—Cooling member; 221—First opening; 222—Second opening; 223—Accommodation cavity; 3*a*—Central heating rod; 3*b*—Central heating sheet; 3*c*—Peripheral heating tube; and 4—Aerosol generation substrate in the related art.

To provide a clearer understanding of the technical features, objectives, and effects of the present invention, specific implementations of the present invention are described in detail with reference to the accompanying drawings. In the following description, it should be understood that orientation or position relationships indicated by the terms such as "front", "rear", "above", "below", "left", "right", "longitudinal", "transverse", "vertical", "horizontal", "top", "bottom", "inside", "outside", "head", and "tail" are based on orientation or position relationships shown in the accompanying drawings and are constructed and operated in a particular orientation, and are used only for ease of description of the technical solution, rather than indicating that the mentioned device or element needs to have a specific orientation. Therefore, such terms should not be construed as limiting of the present invention.

It should be further noted that, unless otherwise explicitly specified and limited, the terms "mount", "connect", "connection", "fix", and "arrange" should be understood in a broad sense. For example, a connection may be a fixed connection, a detachable connection, or an integral connection; or the connection may be a mechanical connection or an electrical connection; or the connection may be a direct connection, an indirect connection through an intermediate medium, internal communication between two elements, or an interaction relationship between two elements. When an element is described as being "above" or "below" another element, the element can be "directly" or "indirectly" located above or below the another element, or there may be one or more intermediate elements. Terms "first", "second", and "third" are used only for ease of description of the technical solution, and shall not be construed as indicating or implying relative importance or implying a quantity of indicated technical features. Therefore, features restricted by "first", "second", and "third" may explicitly indicate or implicitly include one or more such features. A person of ordinary skill in the art may understand specific meanings of the foregoing terms in the present invention according to specific situations.

In the following description, for the purpose of illustration rather than limitation, specific details such as a specific system, structure, and technology are provided to make a thorough understanding of the embodiments of the present invention. However, a person skilled in the art should know that the present invention may also be implemented in other embodiments without these specific details. In other cases, detailed descriptions of well-known systems, devices, circuits, and methods are omitted, so that the present invention is described without being obscured by unnecessary details.

Figure 4:
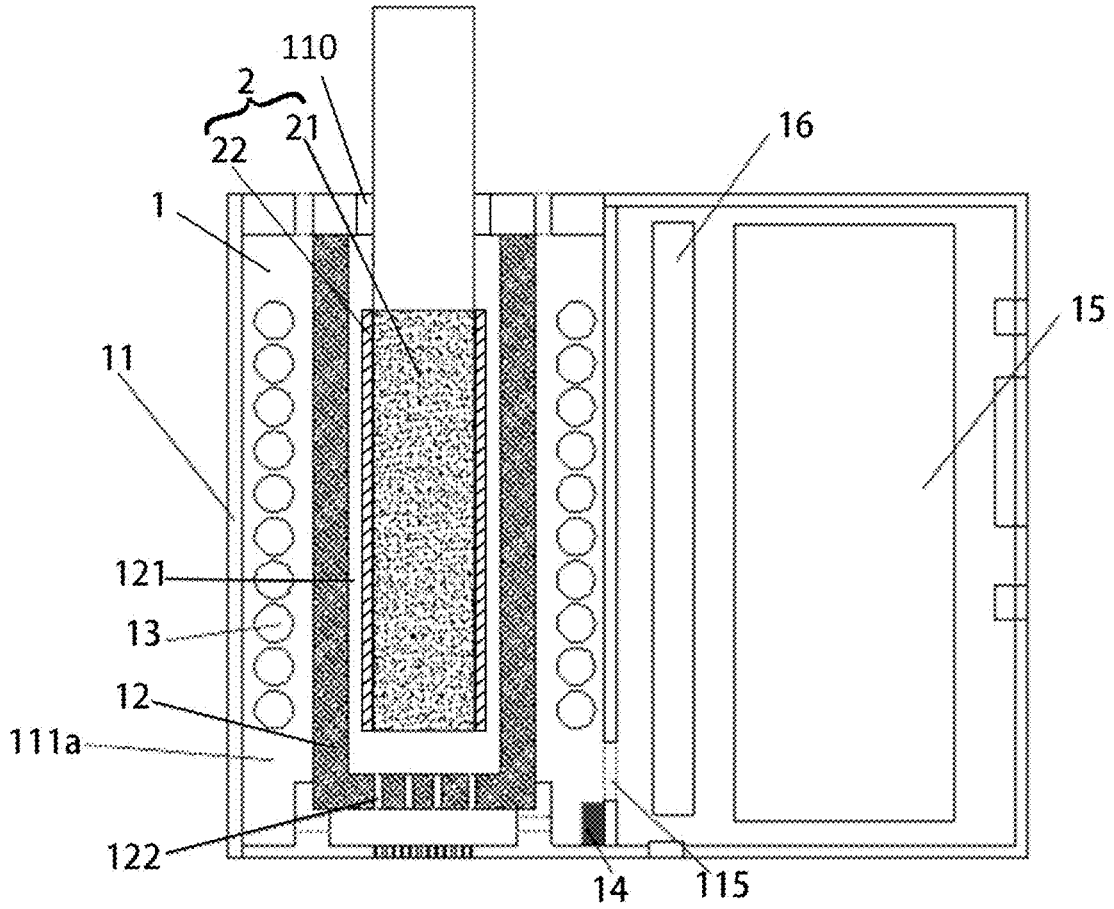
FIG. 4 is a schematic structural diagram of an aerosol generation device according to an implementation of the present invention.
Figure 5:
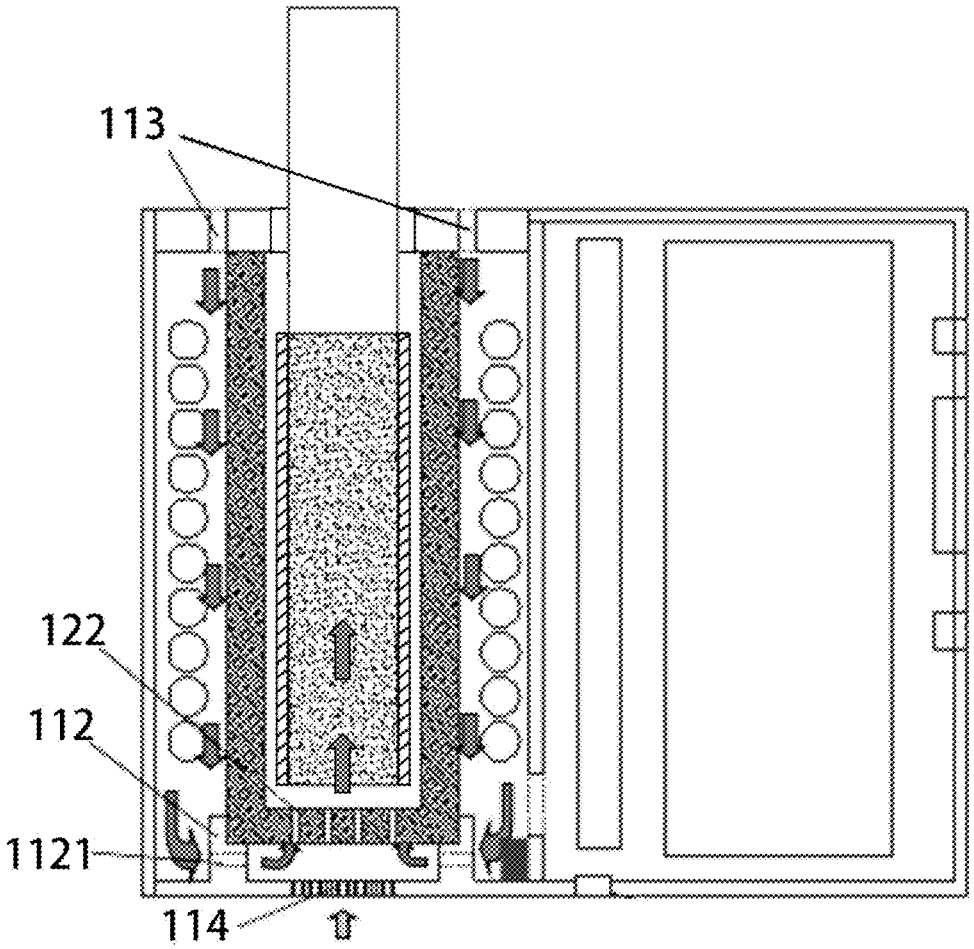
FIG. 5 is a schematic diagram of an airflow direction of an aerosol generation device in FIG. 1.

Referring to FIG. 4 and FIG. 5, an aerosol generation substrate 2 in a first implementation of the present invention includes a main body 21 capable of generating aerosol after being heated, where magnetic particles are distributed in the main body 21, the magnetic particles generate heat through electromagnetic induction to heat the main body 21, and the aerosol generation substrate 2 further includes a cooling member 22 sleeved on the main body 21 and configured to assist in cooling of the main body 21.

The aerosol generation device in this implementation includes the foregoing aerosol generation substrate 2 and a heat-not-burn baking device 1. The heat-not-burn baking device 1 is configured to heat the main body 21 of the aerosol generation substrate 2. The heat-not-burn baking device includes a housing 11, and further includes a supporter 12 and an electromagnetic induction heating assembly 13 that are arranged in the housing 11, and a loading cavity 121 for loading the aerosol generation substrate 2 is provided in the supporter 12, so that the electromagnetic induction heating assembly 13 enables the magnetic particles in the aerosol generation substrate 2 to generate heat through electromagnetic induction, to heat the main body 21 of the aerosol generation substrate 2. The aerosol generation substrate 2 may be loaded into the heat-not-burn baking device 1 for non-contact induction heating.

According to an aspect, since the magnetic particles are distributed in the main body 21 of the aerosol generation substrate 2, thermal energy does not need to be transferred over a long distance. Therefore, the aerosol generation substrate 2 can be quickly baked to generate aerosol, and a heating time is greatly shortened. According to another aspect, since the cooling member 22 is sleeved on the main body 21 of the aerosol generation substrate 2, once heating is stopped, the main body 21 of the aerosol generation substrate 2 can be quickly cooled down under the action of the cooling member 22, thereby achieving the objective of quick heating and quick cooling.

The main body 21 of the aerosol generation substrate 2 generally includes a substrate material capable of releasing volatile compounds. The volatile compounds can form aerosol and the volatile compounds are released by heating the main body 21. The substrate material may include nicotine, and the nicotine-containing substrate material may be a nicotine salt substrate. The substrate material may alternatively include plant-based materials, such as tobacco, and in this case, the aerosol generation substrate 2 may be used as a cigarette.

Such a manner of implementing induction heating through the electromagnetic induction heating assembly 13 and the magnetic particles is based on the law of electromagnetic induction, where when there is an alternating magnetic field in a region surrounded by a circuit, an inductive electromotive force may be generated between two ends of the circuit, and a current is generated when the circuit is closed. In the induction heating, electrical energy is transformed into magnetic energy by using the electromagnetic induction heating assembly 13, and then the magnetic energy is transformed into thermal energy inside a metal workpiece. The electromagnetic induction heating assembly 13 is not in direct contact with the metal workpiece, and the induction heating technology achieves the heating objective in dependence on two types of energy transformation processes. For material selection of the magnetic particles, materials with a high electrical conductivity, a relatively high magnetic conductivity, and a saturated magnetization intensity are preferably selected, for example, Fe powder and/or Ni powder.

In the aerosol generation substrate 2 in some embodiments, the magnetic particles are distributed in the main body 21 of the aerosol generation substrate 2 as evenly as possible, so that the aerosol generation substrate 2 is evenly baked, and the heat spreading capacity of the aerosol generation substrate 2 is improved, thereby resolving the problem of uneven baking. The magnetic particles in a magnetic field and the aerosol generation substrate 2 are controlled to be evenly distributed, so that the thermal energy does not need to be transferred over a long distance, the thermal energy can be substantially evenly distributed, and the aerosol generation substrate 2 is baked as a whole.

For selection of a particle size range of the magnetic particles, the particle size of magnetic powder needs to balance the convenience of implementing electromagnetic induction heating and the convenience of mixing the magnetic particles into the aerosol generation substrate 2. If the particle size is excessively small, it is difficult to implement induction heating, and if the particle size is excessively large, it is difficult to mix the magnetic particles into the main body 21 of the aerosol generation substrate 2. Therefore, the diameter of the magnetic particles ranges from 20 μm to 200 μm, and preferably ranges from 50 μm to 150 μm.

For a mixing proportion of the magnetic particles in the main body 21 of the aerosol generation substrate 2, the mixing proportion of the magnetic particles needs to balance heat generation and heat spreading of the aerosol generation substrate 2, and the impact on the taste further needs to be considered when the aerosol generation substrate 2 is a cigarette. Therefore, the mixing proportion of the magnetic particles in the main body 21 of the aerosol generation substrate 2 may range from 1% to 50%, preferably from 3% to 30%, and is, for example, 6%, 13%, or 22%.

To avoid causing interference to the magnetic particles in the aerosol generation substrate 2, the material of the cooling member 22 is preferably non-magnetic shielding, for example, paramagnetic or diamagnetic. Further, the material of the cooling member 22 may be a heat sink material with a thermal conductivity not less than 10 W/(m·K), a density less than 6000 kg/m$^3$ and/or a specific heat capacity less than 3000 J/(kg·K), which is preferably a heat sink material with the thermal conductivity not less than 20 W/(m·K), the density less than 4000 kg/m$^3$ and/or the specific heat capacity less than 1500 J/(kg·K), for example, a heat sink material with the thermal conductivity of 22 W/(m·K), the density of 3800 kg/m$^3$, and the specific heat capacity of 1400 J/(kg·K), or a heat sink material with the thermal conductivity of 25 W/(m·K), the density of 3500 kg/m$^3$, and the specific heat capacity of 1200 J/(kg·K). The foregoing materials have relatively good heat conducting performance. During inhaling of the aerosol generation substrate 2, the temperature of the materials does not significantly rise due to high-temperature baking of the aerosol generation substrate 2, so that it is beneficial to assist the aerosol generation substrate 2 in being quickly cooled to a relatively low temperature after the inhaling is stopped, thereby further achieving the effect of quick heating and quick cooling, and ensuring that the aerosol generation substrate 2 still has a better taste when being inhaled again after interruption. Specifically, the material of the cooling member 22 may be a ceramic material with the thermal conductivity not less than 20 W/(m·K), such as an aluminum oxide material or an aluminum nitride material.

Figure 6:
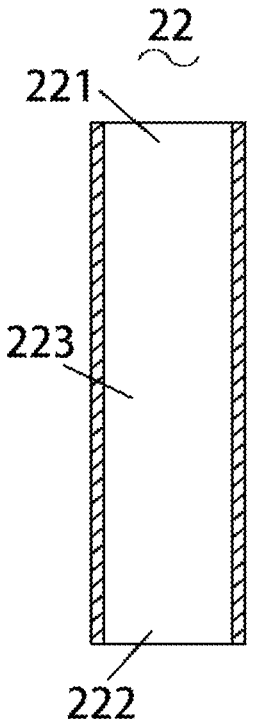
FIG. 6 is a schematic structural diagram of a cooling member according to an embodiment of the present invention.
Figure 7:
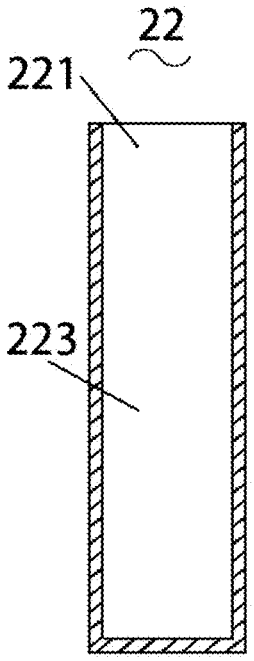
FIG. 7 is a schematic structural diagram of a cooling member according to another embodiment of the present invention.

Referring to FIG. 4 to FIG. 6, in some embodiments, an accommodation cavity 223 and a first opening 221 are provided in the cooling member 22, and the first opening 221 is provided on one side of the cooling member 22 and is in communication with the accommodation cavity 223, so that the main body 21 passes through the first opening 221 and is sheathed in the accommodation cavity 223. A second opening 222 in communication with the accommodation cavity 223 is provided on an other side of the cooling member 22. The cooling member 22 is preferably cylindrical. To be specific, the cooling member 22 may be provided with an opening, that is, the first opening 221 only on one side (referring to FIG. 7), or may be provided with the first opening 221 and the second opening 222 on two sides respectively (referring to FIG. 6).

Referring to FIG. 4 and FIG. 5, in the aerosol generation device in some embodiments, the electromagnetic induction heating assembly 13 may be an induction coil surrounding the periphery of the cooling member 22, where the induction coil preferably surrounds the periphery in the form of a straight solenoid. In addition, since the sizes of mixed magnetic particles are relatively small, the electromagnetic induction heating assembly 13 is preferably at a high frequency or an ultra-high frequency to enable a heat generation power to fall within a range of achieving the heating effect, where the frequency is 150 kHz or above, which is preferably 200 kHz or above, for example, 250 kHz, 280 kHz, or 300 kHz.

Referring to FIG. 4 and FIG. 5, in some embodiments, a shape of the loading cavity 121 of the supporter 12 matches a shape of the aerosol generation substrate 2, and a radial size of the loading cavity 121 is equivalent to a radial size of the aerosol generation substrate 2, and is slightly greater than the radial size of the aerosol generation substrate 2. Specifically, the supporter 12 may be cylindrical, an end of the supporter 12 is open for inserting the aerosol generation substrate 2, and an air hole 122 in communication with inside and outside is provided at an other end of the supporter.

Referring to FIG. 4 and FIG. 5, in some embodiments, an entry 110 is provided on the top of the housing 11, a support portion 112 that supports an end of the supporter 12 provided with the air hole 122 is arranged on the bottom of the housing 11, and an end of the supporter 12 for inserting the aerosol generation substrate 2 corresponds to the entry 110, so that the aerosol generation substrate 2 enters the loading cavity 121 of the supporter 12 through the entry 110. Preferably, the support portion 112 supports an edge of the supporter 12, and the air hole 122 is at a distance from an inner side wall of the housing 11, so that air in the housing 11 flows into the loading cavity 121 through the air hole 122.

Referring to FIG. 4 and FIG. 5, in some embodiments, a first air inlet 113 is provided on the top of the housing 11, so that air flows into the housing 11 and then flows into the loading cavity 121 of the supporter 12. Preferably, in a transverse direction, the first air inlet 113 is located on an outer side of the supporter 12 and is located between the supporter 12 and the electromagnetic induction heating assembly 13. A second air inlet 114 is provided on the bottom of the housing 11, so that air flows into the housing 11 and then flows into the loading cavity 121 of the supporter 12. Preferably, a position of the second air inlet 114 corresponds to an end of the supporter 12 provided with the air hole 122. To be specific, the support portion 112 may be annularly arranged, and a transverse vent channel 1121 is arranged on the support portion. An airflow flowing into the housing 11 through the first air inlet 113 flows between the supporter 12 and the electromagnetic induction heating assembly 13 and then flows into the loading cavity 121 of the supporter 12 sequentially through the vent channel 1121 of the support portion 112 and the air hole 122 of the supporter 12; and an airflow flows into the housing 11 through the second air inlet 114 and then flows into the loading cavity 121 of the supporter 12 through the air hole 122. An airflow direction is shown in FIG. 5.

Referring to FIG. 4 and FIG. 5, the heat-not-burn baking device 1 may further include an air pressure sensor 14, a circuit control unit 16, and a power supply 15 for supplying electric energy that are arranged in a second cavity 111*b* of the housing 11, where the second cavity 111*b* is provided on one side of a first cavity 111*a*, and a hole 115 in communication with a first housing 11*a* and a second housing 11*b* is provided in the housing 11 for lines in the first housing 11*a* and the second housing 11*b* to pass through. The air pressure sensor 14 is configured to sense an airflow flowing into the loading cavity 121 of the supporter 12. The circuit control unit 16 is electrically connected to the air pressure sensor 14 and the electromagnetic induction heating assembly 13 to control start and stop of the electromagnetic induction heating assembly 13. The air pressure sensor 14 may be arranged at a position of an air vent of the vent channel 1121 of the support portion 112, and the start and stop of the electromagnetic induction heating assembly 13 are determined according to the sensing of the air pressure sensor 14. To be specific, the electromagnetic induction heating assembly 13 starts heating when an airflow is sensed, the electromagnetic induction heating assembly 13 stops heating when no airflow is sensed, and the aerosol generation substrate 2 is quickly cooled down under the action of the cooling member 22, thereby achieving immediate inhaling and immediate inhaling stop of a low-temperature cigarette.

In a second implementation of the present invention, the aerosol generation substrate 2 and the heat-not-burn baking device 1 in the first implementation are applied to the field of low-temperature baking cigarettes. In this case, the substrate material of the main body 21 of the aerosol generation substrate 2 includes cut tobacco, and the aerosol generation substrate 2 is used as a cigarette. The cigarette may be loaded into the heat-not-burn baking device 1 for non-contact induction heating, thereby releasing tobacco extract from the tobacco in a non-burning state.

Since magnetic particles are distributed in the cigarette, thermal energy does not need to be transferred over a long distance (due to a low thermal conductivity of the tobacco and slow heat transfer). Therefore, the tobacco in the cigarette can be quickly baked to generate aerosol, and a long wait before inhaling is avoided, thereby greatly shortening a heating time. The magnetic particles are added into the cigarette, and the cooling member 22 for assisting in the cooling is designed on an outer side of the cigarette, so that the cigarette can be quickly cooled down once the heating is stopped, thereby achieving the objective of quick heating and quick cooling.

For a manner of mixing the magnetic particles, since common reconstituted tobacco leaf preparation processes include separation and extraction, concentration, pulping, forming, coating, and cutting, mixing the magnetic particles during the pulping may be considered, which mainly means that the magnetic particles can be evenly mixed in a case that the impact on the tobacco leaf preparation processes is minimized.

In addition, current low-temperature baking cigarettes still have some problems.

Figure 2:
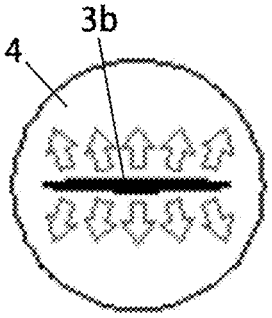
Figure 3:
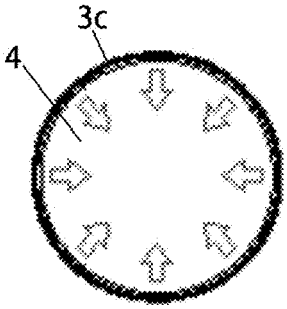

First, the heating manner described in the related art is used in the existing low-temperature baking cigarettes. As a result, the cigarettes cannot be evenly baked, and it takes a long time to preheat. A heating element generates heat and then transfers thermal energy to heat the tobacco. Due to loosely stacked tobacco and a low thermal conductivity (where the thermal conductivity only ranges from 0.025 W/(m·K) to 0.05 W/(m·K)), the tobacco has the problem of uneven baking regardless of the form of the heating element (the form of a sheet, the form of a rod, or the form of a peripheral tube). As shown in FIG. 1 to FIG. 3, heat in a central heating sheet 3*b* and a central heating rod 3*a* is transferred from the center to the periphery, and heat in a peripheral heating tube 3*c* is transferred from the periphery to the inside. Since a baking distance changes, tobacco close to the heating element is likely to be scorched and produce a burnt smell, and tobacco far away from the heating element is insufficiently baked and the taste continuously changes with the inhaling taste.

Second, tobacco utilization is low. The tobacco in a region far away from the heating element is insufficiently baked to avoid the problem such as the severe burnt smell of the tobacco close to the heating element (due to the low thermal conductivity of the tobacco and a sharp cross-sectional temperature gradient of the cigarette). Therefore, the tobacco utilization is relatively low.

Third, the heating element is difficult to clean. After repeated use, tobacco tar generated by baking the cigarette and coking dust on a surface of the heating element are stuck on the surface of the heating element. As a result, soot is formed, which is difficult to clean, and the taste is affected after a long time.

In view of the foregoing problems, in some embodiments of the present invention, the magnetic particles are distributed in the main body 21 of the aerosol generation substrate 2 that is used as a cigarette as evenly as possible, so that tobacco in the cigarette is evenly baked, and the heat spreading capacity of the main body 21 is improved, thereby resolving the problem of uneven baking. The magnetic particles in a magnetic field and the aerosol generation substrate 2 are controlled to be evenly distributed, so that the thermal energy does not need to be transferred over a long distance, the thermal energy can be substantially evenly distributed, and the aerosol generation substrate 2 is baked as a whole, thereby improving the tobacco utilization. In addition, the burnt smell caused by high-temperature baking is avoided, and the inhaling taste can be improved to some extent. Furthermore, the substantial heating element in the non-contact electromagnetic induction heating is ferromagnetic particles in the aerosol generation substrate 2, which are replaced after inhaling, and there is no problem of cleaning the heating element.

Based on the above, the aerosol generation device of the present invention includes the heat-not-burn baking device 1 and the aerosol generation substrate 2. Since the magnetic particles are distributed in the main body 21 of the aerosol generation substrate 2, the thermal energy does not need to be transferred over a long distance. Therefore, the heating time is greatly shortened, aerosol can be quickly generated, and the heat spreading capacity of the main body 21 is improved. In addition, the cooling member 22 for assisting in the cooling is designed on an outer side of the aerosol generation substrate 2, so that the aerosol generation substrate 2 can be quickly cooled down once the heating is stopped, thereby achieving the objective of quick heating and quick cooling. In addition, the magnetic particles in a magnetic field and the aerosol generation substrate 2 are controlled to be evenly distributed, so that the thermal energy can be substantially evenly distributed, and the main body 21 of the aerosol generation substrate 2 is baked as a whole. Furthermore, the heat-not-burn baking device 1 may be provided with the air pressure sensor 14 configured to sense an airflow flowing into the loading cavity 121 of the supporter 12. Therefore, immediate inhaling and immediate inhaling stop of the low-temperature cigarette are achieved by controlling the start and stop of the electromagnetic induction heating assembly 13.

The technical solutions of the heat-not-burn baking device 1 and the aerosol generation substrate 2 of the present invention are particularly applicable to the low-temperature baking cigarette. In this case, the main body 21 of the aerosol generation substrate 2 includes cut tobacco, and the aerosol generation substrate 2 is used as a cigarette. Since the magnetic particles are distributed in the cigarette, the thermal energy does not need to be transferred over a long distance. Therefore, the tobacco in the cigarette can be quickly baked to generate aerosol, and a long wait before inhaling is avoided, thereby greatly shortening the heating time. The magnetic particles are added into the cigarette, which improves the heat spreading capacity of the cigarette, and the cooling member 22 for assisting in the cooling is designed on an outer side of the cigarette, so that the cigarette can be quickly cooled down once the heating is stopped, thereby achieving the objective of quick heating and quick cooling. In addition, the magnetic particles in a magnetic field and the cigarette are controlled to be evenly distributed, so that the thermal energy can be substantially evenly distributed, and the cigarette is baked as a whole, thereby improving the tobacco utilization. In addition, the burnt smell caused by high-temperature baking is avoided, and the inhaling taste can be improved to some extent. Furthermore, the substantial heating element in the non-contact electromagnetic induction heating is the magnetic particles in the cigarette, which are replaced after inhaling, and there is no problem of cleaning the heating element.

The above descriptions are merely exemplary implementations of the present invention and are not intended to limit the present invention. A person skilled in the art may make various modifications, combinations, and variations to the present invention. Any modification, equivalent replacement, or improvement made within the spirit and principle of the present invention shall fall within the protection scope of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An aerosol generation device, comprising:

an aerosol generation substrate comprising:

a main body configured to generate aerosol after being heated, magnetic particles being distributed in the main body, the magnetic particles being configured to generate heat through electromagnetic induction to heat the main body, and a cooling member sleeved on the main body and configured to assist in cooling of the main body; and a heat-not-burn baking device configured to heat the main body of the aerosol generation substrate, the heat-not-burn baking device comprising:

a housing, a supporter, and an electromagnetic induction heating assembly that are arranged in the housing, a loading cavity configured to load the aerosol generation substrate being provided in the supporter such that the electromagnetic induction heating assembly enables the magnetic particles in the aerosol generation substrate to generate heat through electromagnetic induction so as to heat the main body of the aerosol generation substrate, wherein the cooling member comprises a heat sink material, wherein the cooling member comprises a ceramic material wherein the cooling member comprises an aluminum oxide material or an aluminum nitride material, wherein a support portion is arranged on the bottom of the housing, the support portion supporting an end of the supporter, and wherein the support portion is provided with a vent channel.

2. The aerosol generation device of claim 1, wherein a thermal conductivity of the cooling member is not less than 10 W/(m·K), a density is less than 6000 kg/m$^3$, and/or a specific heat capacity is less than 3000 J/(kg·K).

3. The aerosol generation device of claim 2, wherein the thermal conductivity of the cooling member is not less than 20 W/(m·K), the density is less than 4000 kg/m$^3$, and/or the specific heat capacity is less than 1500 J/(kg·K).

4. The aerosol generation device of claim 1, wherein the cooling member comprises non-magnetic shielding.

5. The aerosol generation device of claim 4, wherein the cooling member is paramagnetic or diamagnetic.

6. The aerosol generation device of claim 1, wherein an accommodation cavity is provided in the cooling member, and a first opening in communication with the accommodation cavity is provided on one side of the cooling member such that the main body passes through the first opening and is sheathed in the accommodation cavity.

7. The aerosol generation device of claim 6, wherein a second opening in communication with the accommodation cavity is provided on an other side of the cooling member.

8. The aerosol generation device of claim 1, wherein the magnetic particles comprise an Fe material and/or a Ni material.

9. The aerosol generation device of claim 1, wherein diameters of the magnetic particles range from 20 μm to 200 μm.

10. The aerosol generation device of claim 8, wherein diameters of the magnetic particles range from 50 μm to 150 μm.

11. The aerosol generation device of claim 1, wherein a mixing proportion of the magnetic particles in the main body ranges from 1% to 50%.

12. The aerosol generation device of claim 11, wherein the mixing proportion of the magnetic particles in the main body ranges from 3% to 30%.

13. The aerosol generation device of claim 1, wherein a frequency of the electromagnetic induction heating assembly is 150 kHz or above.

14. The aerosol generation device of claim 13, wherein the frequency of the electromagnetic induction heating assembly is 200 kHz or above.

15. The aerosol generation device of claim 1, wherein an end of the cooling member is open for inserting a cigarette, an air hole in communication with inside and outside is provided at an other end of the cooling member on the end of the supporter, and the air hole is at a distance from an inner side wall of the housing such that air in the housing flows into the loading cavity through the vent channel and through the air hole.

16. The aerosol generation device of claim 1, wherein a first air inlet is provided on a top of the housing, and/or wherein a second air inlet is provided on the bottom of the housing such that air flows into the housing and then flows into the loading cavity of the supporter.

17. The aerosol generation device of claim 1, wherein a first air inlet is provided on a top of the housing, and wherein the first air inlet and the vent channel are in fluid communication so as to facilitate passage of air from an external environment through the first air inlet, through the second air inlet, and into the loading cavity.

18. The aerosol generation device of claim 1, wherein the supporter is a cylinder with an open end, the open end being aligned with an entry opening of the housing, and wherein the supporter and the entry opening fully delimit the loading cavity.

* * * * *